United States Patent [19]

Watson

[11] Patent Number: 4,720,184

[45] Date of Patent: Jan. 19, 1988

[54] REVERSING AND NON-REVERSING MIRROR DEVICE

[76] Inventor: William Watson, 174 W. 76 St., New York, N.Y. 10023

[21] Appl. No.: 843,800

[22] Filed: Mar. 27, 1986

Related U.S. Application Data

[63] Continuation-in-part of Ser. No. 581,526, Feb. 21, 1984, Pat. No. 4,580,880.

[51] Int. Cl.[4] ..... G02B 5/08; G02B 7/18

[52] U.S. Cl. ..... 350/617; 350/616; 350/631; 272/8 M

[58] Field of Search ..... 350/615, 616, 617, 621, 350/600, 631; 272/8 M

[56] References Cited

U.S. PATENT DOCUMENTS

| | | | |
|---|---|---|---|
| 370,623 | 9/1887 | Hooker | 350/617 |
| 533,167 | 1/1895 | Fuller | 350/627 |
| 813,136 | 2/1906 | Balch | 350/617 |
| 1,991,054 | 2/1935 | Hampke | 350/618 |
| 2,036,184 | 4/1936 | Armstrong | 350/616 |
| 2,059,823 | 11/1936 | Sunderhauf | 350/616 |
| 3,022,709 | 2/1962 | Duggan | 350/617 |

FOREIGN PATENT DOCUMENTS

| | | | |
|---|---|---|---|
| 3103495 | 8/1982 | Fed. Rep. of Germany | 350/627 |
| 446497 | 8/1893 | France | 350/617 |
| 2380562 | 9/1978 | France | 359/617 |

*Primary Examiner*—Jon W. Henry

*Attorney, Agent, or Firm*—Lieberman, Rudolph and Nowak

[57] ABSTRACT

The instant invention is an optical device intended primarily as a mirror for the application of cosmetic products, procedures or for other fashion related items. The mirror device permits the user to view two images of himself, or herself, either side-by-side or separately. One image is a standard mirror image with left and right reversed and the other image is the true non-reversed image perceived by others. The observer perceives each image as appearing on a single rectangular viewing surface with more of a three-dimensional, vivid and colorful appearance than a normal plane mirror. This mirror can be easily assembled and transported in a compact version.

8 Claims, 7 Drawing Figures

FIG. 5
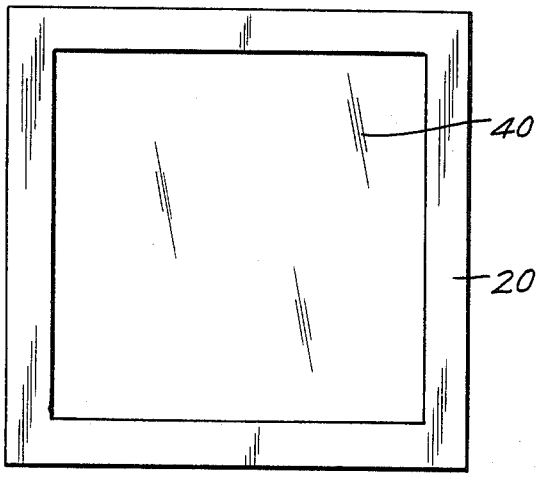
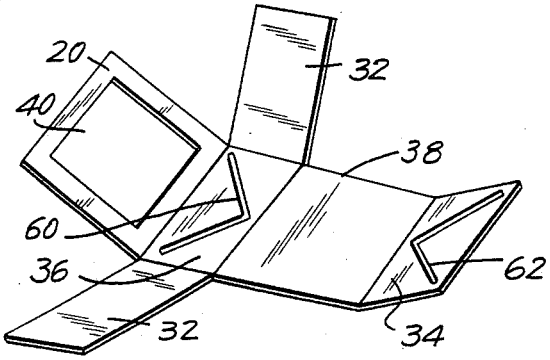
FIG. 6

REVERSING AND NON-REVERSING MIRROR DEVICE

This application is a continuation-in-part of application Ser. No. 581,526, filed Feb. 21, 1984, now U.S. Pat. No. 4,580,880.

FIELD OF THE INVENTION

The instant invention is an optical device intended primarily for use as a mirror in applying cosmetics, trying on clothing or accessories, or for hair styling. The mirror device permits the user to view herself (or himself) in two images simultaneously: from a standard mirror image with left and right reversed and as a true non-reversed image such as is perceived by others. Further, the mirror device creates three dimensional effects so as to create images of the viewer more useful, accurate and vivid than before. And lastly, the device may be easily manufactured in a collapsible compact version.

DESCRIPTION OF THE PRIOR ART

It has been said that man's obsession with looking at his image in a mirror is not really so much from desire to see what he looks like, but rather how he appears to others.

Indeed, the entire field of cosmetics for both men and women is based on products, technology and methods of application that will alter or improve the way that others see us. The most commonly used device for perceiving how we appear to others is the single plane mirror. While people normally assume that what they see in the single place mirror is an accurate representation of how they look to others, this is not so. First, the standard plane mirror presents a reversed image. Second, a plane mirror flattens the image, losing an important sense of three-dimensionality, because the traditional mirror does not provide the eyes with true-to-life depth of field. Third, the usual plane mirror will distort the color of both skin and applied cosmetics because the texture will be flattened as a result of the reflection of not only the image, but also all the direct and indirect lighting and color tones present in the room.

It is well known that two plane mirrors placed at right angles to each other will provide a "true" non-reversed image. See U.S. Pat. No. 370,623 of September 1887 to Hooker. But there are two basic problems caused by this design. First, it is disconcerting to view an image on two converging planes rather than on a single, flat field. Second, it is difficult to apply make-up because eye-to-hand motor coordination is accustomed to dealing with the reversals of a plane mirror.

These problems were solved in my U.S. Pat. No. 4,580,880. The instant disclosure is based on the same principle of creating a nonreversing mirror with perceived depth perspective by utilizing the combination of actual angles and distance with reflected angles and distance. While my previous disclosure had many advantages, the device itself could not be easily manufactured in a collapsible or compact version. Moreover, it utilized three, not two mirrors, and required vertical eye movement for eye-hand coordination, external artificial light, a black chamber area and baffles to block ambient light.

SUMMARY OF THE INVENTION

These and other difficulties in the prior art are overcome by the instant invention of a collapsible non-reversing mirror device primarily for use in the application of cosmetic products and procedures, which makes it possible for the observer to view herself simultaneously in both a standard plane mirror with a reversed image and in a "true" mirror with a non-reversed image. The device contains two mirrors, but is arranged to provide the perception of three mirror groups, each with a different function.

The observer perceives each image as being on a single rectangular viewing surface. All the reflections appear more three-dimensional than in the prior art and have true color texture reproduction. And, both reversed and non-reversed views of the user's face can be seen side-by-side with only a slight repositioning of the angle of perception or movement of the device itself.

Two of the images, one viewed from the left side and the other viewed from the right side, are the standard reveresed view which gives the user the familiar frame of reference for eye-hand coordination necessary to conveniently apply cosmetic products and procedures. The third image is a true non-reveresed view, showing how other people see the user, and provides corrective information about how the user really looks. All three have the three-dimension effect, perceived depth perspective and more accurate color-texture reproduction. The actual adjustments and changes are done with reference to the standard reversed views which provides for easier eye-hand coordination.

Although the instant device can be constructed with a particular housing enclosing two mirrors at particular distances and angles, i.e. in a "V" configuration, the user perceives none of this. Instead, he sees only one rectangular image when the angle of perception is perpendicular to the cube. From a different angle of perception, or by moving the device slightly in either direction, the viewer has the capability of perceiving two other mirror groups. As it will be seen from the detailed description below, the perceived borders and images of these mirror groups are really quite different from the actual borders and construction of the mirror device because the combination of mirrors and borders at certain angles and distances combine to create a unique perceptual effect.

The mirrors need not be stationary and may be moved in relation to one or the other. Accordingly, the entire device can collapse into essentially one plane or a flat package. For purposes of a vanity mirror, this collapsibility would provide a compact version easily inserted into a women's purse or man's suit pocket.

The mirror device can be used without its own lighting source, using the ambient light. Alternatively, different light sources could be used from above the device in order to simulate different conditions. A light source with a translucent filter on top of the device, or even a translucent filter alone, could also be used to simulate such conditions. In addition, by using a mirror on the floor of the device the user has a non-reversed image from above. Printed or other material placed on the floor plane, along with the existing non-reveresed image on a vertical plane. The ceiling, floor on both can be used in still other ways, such as providing background or reference images (e.g., a color chart).

BRIEF DESCRIPTION OF THE DRAWINGS

FIG. 1(*a*) is a view of the mirror device shown in FIG. 1 showing the three illusory reflected images.

FIGS. 4 and 5 represent the mirror combination and the front viewing screen in isolation from the rest of the device.

FIG. 6 represents a schematic of a collapsible mirror device before assembly.

DESCRIPTION OF THE PREFERRED EMBODIMENT

Figure 1:
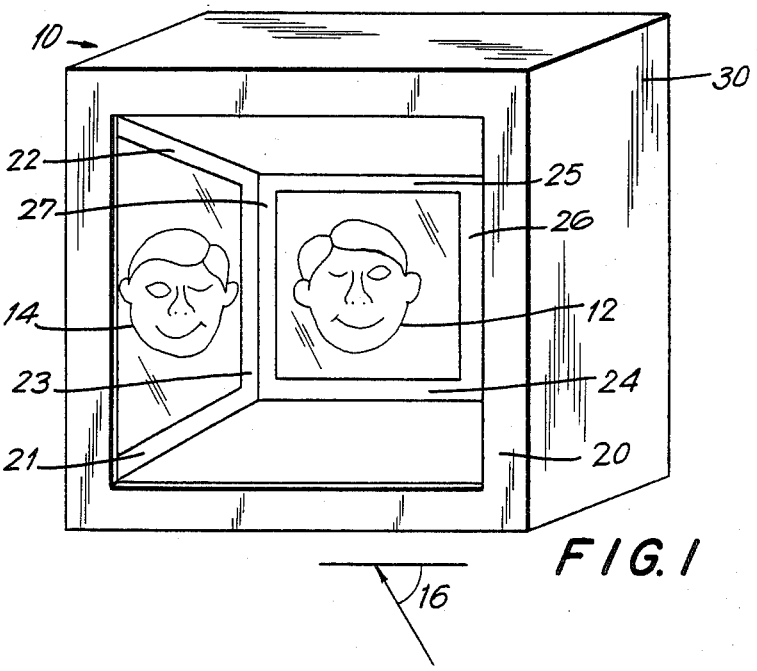
FIG. 1 is a view of the mirror device showing side-by-side reflections of a standard mirror image of a user on the left and the non-reversed image on the right.

In accordance with the instant invention, there is supplied a mirror device 10 which produces at least a first image 12 and a second image 14. The first image 12 is a true or non-reversed image and can be seen when the angle of perception 16 is relatively perpendicular to the device. The second image 14 is a reflection normally seen in a plane mirror and can be seen when the angle of perception 16 is somewhat off-perpendicular. Depending on the angle of perception, both images may be viewed simultaneously or each separately.

The perspective illusions are created and defined by various borders which are produced by the elements of the physical construction of the mirror device. Only the frame 20 physically exists. Borders 21, 22, 23, 24, 25 and 26 are illusory images which are clearly perceived by looking into the device through frame 20. In particular, the perspective and rectangular illusions are created by the interior borders of the frame 20, which are largely rectangular and manufactured from any material. One effect could be created by other frame shapes, e.g. oval, circle, triangle or otherwise. For convenient reference, the illusion or image and its borders will be described as well as the physical construction which produces the image illusion and borders. The reversed image 14, which appears to be projected on the inner left wall of the housing 30, there is a perceived lower or bottom border 21, upper border 22, and side border 23. For the non-reversed image 12 in the center of the inner rear wall, there is a lower border 24, upper border 25, right side border 26 and a left side border 27. The mirror image from the interior of the frame 20 forms the borders of these images.

Because the frame 20 has an interior border and fits up against the V mirror configuration, a flat plane effect is created for the non-reversed image. These borders eliminate the user's perception of the V-shaped construction of the two mirrors, allowing the user to perceive the non-reversed image 12 as existing in a simple plane, rather than disconcertingly being formed by two right angle mirrors. By simply looking towards the back left or right corner instead of looking directly into the housing 30 in a line perpendicular to frame 20, i.e., by changing the angle of perception 16, the reversed image on either side can be viewed at the same time as the back non-reversed image. When viewed in this manner, the viewer will see a non-reversed, three-quarter frontal view, for example, and a one-quarter reversed view. FIG. 1(*a*) describes what the user sees when she looks directly into the front of the housing 30. The reversed image appears to be projected on the inner left wall of the housing 30 and an identical reverse image 15 appears to be projected on the inner right wall of the housing 30. The overall illusion to the viewer is the appearance of three distinct mirrors placed along the left, right and rear inner walls of housing 30. In actuality there are physically only two mirrors which are arranged as shown in FIGS. 2 thru 4 and described below.

Figure 2:
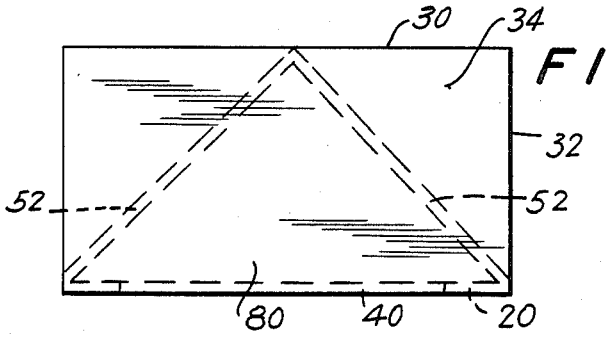
FIG. 2 is a top cut-away view of the mirror device.
Figure 1A:
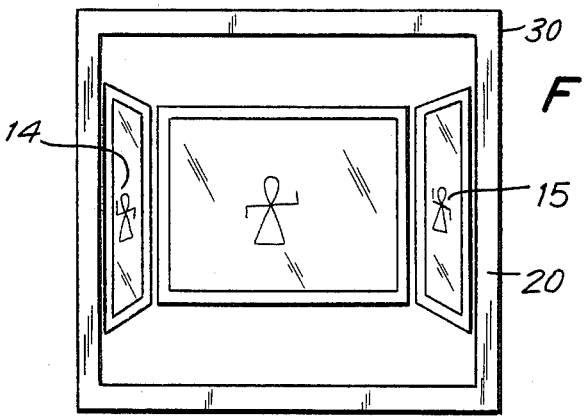
Figure 3:
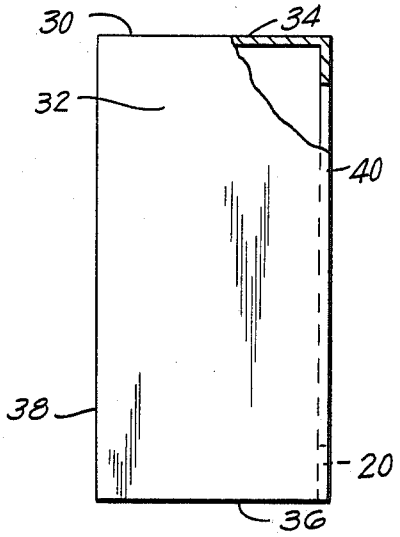
FIG. 3 is a side cut-away view of the mirror device.

As shown in FIGS. 2 and 3, the mirror device 10 is generally enclosed in a housing 30. The housing 30 could comprise sides 32, top 34, bottom 36, and rear 38 or could be in many other forms, e.g. circular, triangular or combinations of both. The top and bottom interior of the housing, the interior borders, or both can be any color. One effect, giving particularly accurate and vivid color, can be achieved if the interior is covered with a light absorbing material, such as black felt, which will eliminate, or substantially reduce interior reflection and thus improve the quality of the colors and image. Striking effects can be achieved by patterns on the interior borders, such as a thin red stripe on a black background. However, any color, texture or combination of the two, will suffice, depending on the effect desired. The front of the housing is supplied by the viewing screen 40 and surrounding frame 20.

Figure 4:
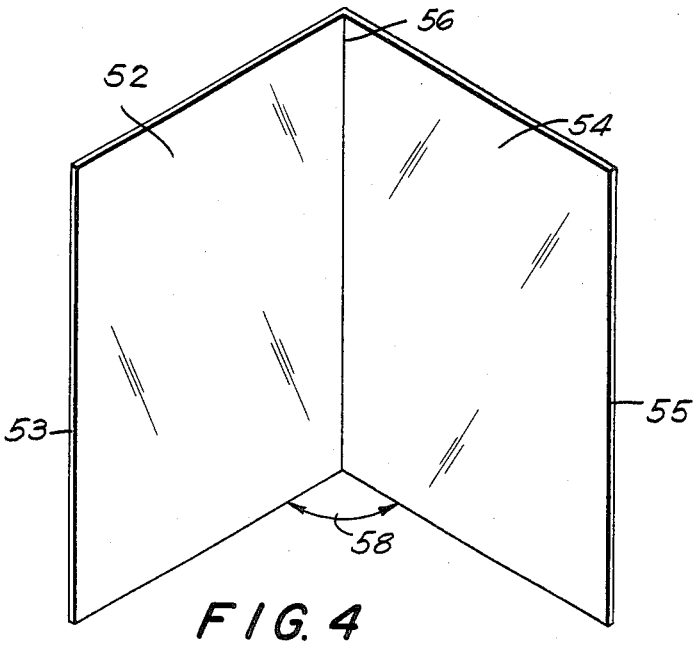

As shown in FIG. 4, within the mirror device 10, a left mirror 52 and a right mirror 54 are included. At the intersection of the two mirrors, there may be a slightly visible center line 56 running vertically down the non-reversed image. For some applications, it is preferred in the construction to minimize or eliminate this center line to reduce this distraction. The angle 58 between the mirrors should be at 90 degrees. However, it is understood that by reducing the angle to less than 90 degrees, two non-reversed side-by-side images are created. To maximize space within the device, and to create the illusions, the left edge of the left mirror 53 and the right edge of the right mirror 55 may fit up against the interior of the frame 20.

The ceiling or top triangular area 80 over the chamber in the mirror device may allow light into the interior of the chamber. This light will not affect either the perceived depth perspective or the illusion that the image is on a flat plane. Accordingly, the top of the device 34 can be made from a lighting device, glass, some type of filter, translucent or even solid. If the top is solid then the chamber will not be illuminated and either natural or artificial light from the outside would be used to illuminate the user.

The floor of the device 36 can be made from many different materials in order to produce many different effects. By placing printed or other material as or on the floor, for example, the user has a non-reversed image of this information from a horizontal plane appearing at the back of the chamber, along with the existing non-reversed image on a vertical plane. If a mirror is used on or as the floor, the viewer can see a non-reversed image of himself or herself from above by looking down into the device. Alternatively, the use of visual patterns or information printed on the floor of the device might also convey information, increase the depth perspective or both. Because the image would be non-reversed, an individual color chart with words and figures might be used for easy eye reference. The chart could also rotate within the device so that different information would appear in the front triangular portion of the floor.

The viewing screen 40, which forms one side of the enclosure of the mirror device 10 may be manufactured from numerous different materials, such as plastic or glass. Alternatively, the viewing screen 40 may be eliminated, leaving just the frame 20. Assuming a large enough device, this would enable one to actually enter the chamber. Then, by reducing the angle between the mirrors 58, a viewer would be able to see two non-reversed images of himself or herself side-by-side. This version might be useful in hair dressing salons or clothing stores.

One of the other features of the mirror device is also that it is spacially efficient and may be collapsed into a relatively small package. Because the V mirror configuration can be made to fit up against both the interior of the frame 20, and the back of the device 38, there is no lost space. As seen in FIG. 6, prior to assembly, the housing 30 may be formed from a solid piece of material defined by six discrete geometric shapes which can be folded into an orthogonal box defining the sides of the device. Upon assembly, the device could be secured by Velcro, snaps or some other type of fastening device. The mirror configuration could slip in and out of grooves 60, 62, which appear in both the bottom 36 and top 34 of the interior of the device, respectively.

Although one embodiment of the instant invention has been described above, numerous variations and changes could be made within the scope of the instant invention. For instance, magnifying mirrors could be used for some or all images. It is not intended by describing the details of one construction to limit the invention in any way.

I claim:

1. A mirror device for viewing a subject, said device providing a non-reversed reflected image of said subject and at least one reversed reflected image of said subject, said device comprising:

first and second mirrors disposed with respect to each other to provide said reflected images; and a three dimensional substantially hollow housing containing said mirrors, a first end of said housing partially opened forming a frame around the perimeter of said first end; said frame having an inside portion of substantial width throughout the entire continuous perimeter of said frame;

whereby when said subject is placed proximate to said first end, reflected each of said images appear to be on separate surfaces within said housing surrounded by a perceived border caused by the reflection of said frame.

2. A mirror device as in claim 1, wherein the inner floor of the device comprises visual material.

3. A mirror device as in claim 1, wherein the ceiling of the device comprises a means for controlling the light within the housing.

4. A mirror device as in claim 1, wherein three, three-dimensionally framed images are perceived by a user looking into said first end, a non-reversed image of the user appearing on the inner rear wall of said housing in front of said user, and standard reversed images of the user appearing on side walls to the left and right of said first end.

5. A mirror device as in claim 1, wherein the mirrors are arranged so as to substantially fit against the front of the device.

6. A mirror device as in claim 1, wherein the mirrors are arranged so as to substantially fit against the back of the device.

7. A mirror device as in claim 6, wherein the device may be easily collapsed into a compact version.

8. A mirror device as in claim 1, wherein the inner floor of the device comprises a mirror.

* * * * *